US006712211B1

(12) United States Patent
Chan

(10) Patent No.: US 6,712,211 B1
(45) Date of Patent: Mar. 30, 2004

(54) STATIONERY HOLDER

(75) Inventor: Sik-Leung Chan, New Territories (CN)

(73) Assignee: C. C. & L Company Limited, Tsuen Wan (CN)

( * ) Notice: Subject to any disclaimer, the term of this patent is extended or adjusted under 35 U.S.C. 154(b) by 0 days.

(21) Appl. No.: 10/377,927

(22) Filed: Mar. 3, 2003

(51) Int. Cl.[7] ..... B65D 73/00

(52) U.S. Cl. ..... 206/457; 206/214; 446/73; 446/379; 446/381

(58) Field of Search ..... 206/457, 214, 206/224, 371, 301, 18; 446/72, 73, 75, 317, 330–332, 376–379, 381, 383, 390; 368/45, 276, 278

(56) References Cited

U.S. PATENT DOCUMENTS

| | | | | | |
|---|---|---|---|---|---|
| 2,760,303 | A | * | 8/1956 | Del Mas | 446/381 |
| 2,804,721 | A | * | 9/1957 | Cohn | 446/381 |
| 3,566,535 | A | * | 3/1971 | Handler et al. | 446/381 |
| 4,740,187 | A | * | 4/1988 | Rasmussen et al. | 206/457 |
| 4,753,346 | A | * | 6/1988 | Tsuji | 206/457 |
| 6,115,328 | A | | 9/2000 | Chan | |
| 6,178,085 | B1 | | 1/2001 | Leung | |
| 6,206,281 | B1 | | 3/2001 | Leung | |
| 6,249,431 | B1 | | 6/2001 | Chan | |
| 6,324,557 | B1 | | 11/2001 | Chan | |
| 6,443,615 | B1 | | 9/2002 | Chan | |
| 6,508,396 | B1 | | 1/2003 | Chan | |
| 6,568,984 | B1 | * | 5/2003 | Applewhite | 446/379 |

* cited by examiner

*Primary Examiner*—Luan K. Bui
(74) *Attorney, Agent, or Firm*—Alix, Yale & Ristas, LLP

(57) ABSTRACT

A stationery holder comprises a body, a limb attached movably to and extending from the body, a spring interposed between the body and the limb and biasing the limb to move with respect to the body, a stationery receiver at or near a distal end of the limb, and a release mechanism for allowing the spring to move the limb with respect to the body.

14 Claims, 6 Drawing Sheets

STATIONERY HOLDER

BACKGROUND OF THE INVENTION

The present invention relates to a stationery holder. More particularly, although not exclusively, the invention relates to a stationery holder having pivotable limbs at distal ends of which stationery items can be held and presented to a user upon demand.

Penholders, cardholders and writing pad holders are common desktop items. These known items however are static and therefore provide little user-interaction.

OBJECT OF THE INVENTION

It is the object of the present invention to overcome or substantially ameliorate the above disadvantage and/or more generally to provide improved stationery holder.

DISCLOSURE OF THE INVENTION

There is disclosed herein a stationery holder comprising:

a body, a limb attached movably to and extending from the body, a spring interposed between the body and the limb and biasing the limb to move with respect to the body, a stationery receiver at or near a distal end of the limb, and a release mechanism for allowing the spring to move the limb with respect to the body.

The limb would typically be attached pivotally to the body.

The stationery receiver would typically comprise a hollow cylinder having a closed end and an open end through which a pen might extend.

The and/or another stationery receiver might comprise a slot into which an edge portion of sheet material might be received tightly.

Preferably the pivotal attachment of the limb to the body comprises a tube fixed with respect to the limb or body and within which the spring is located and connected to the tube, and a shaft fixed with respect to the other of the limb or body and extending into the tube and connected to the spring.

There is typically viscous lubricant between the shaft and tube providing resistance against pivotal movement therebetween.

Preferably the release mechanism comprises a key-in-slot arrangement at an outside surface of the tube.

The key-in-slot arrangement preferably comprises a key mounted pivotally with respect to said limb or body and an exposed pushbutton extending from the key.

The key is typically mounted at a pivot pin, at one side of which there is a return spring and at the other side of which there is said pushbutton.

Preferably the stationery holder further comprises a pivot-limiting stopper preventing over-pivoting of the limb with respect to the body.

There is typically a pair of said limbs, each resembling arms.

The stationery holder might also comprise a head extending from the body and having internal illumination activatable upon depression of the head.

There might also be a clock and an LCD display on the body for displaying time.

There might further be feet upon which the body sits and at least one of the feet could have a bottom for activating the clock.

Preferably, the stationery dispenser further comprises a notepad holder extending from the body and resembling a backpack.

BRIEF DESCRIPTION OF THE DRAWINGS

A preferred form of the present invention will now be described by way of example with reference to the accompanying drawings, wherein.

DESCRIPTION OF THE PREFERRED EMBODIMENT

Figure 1:
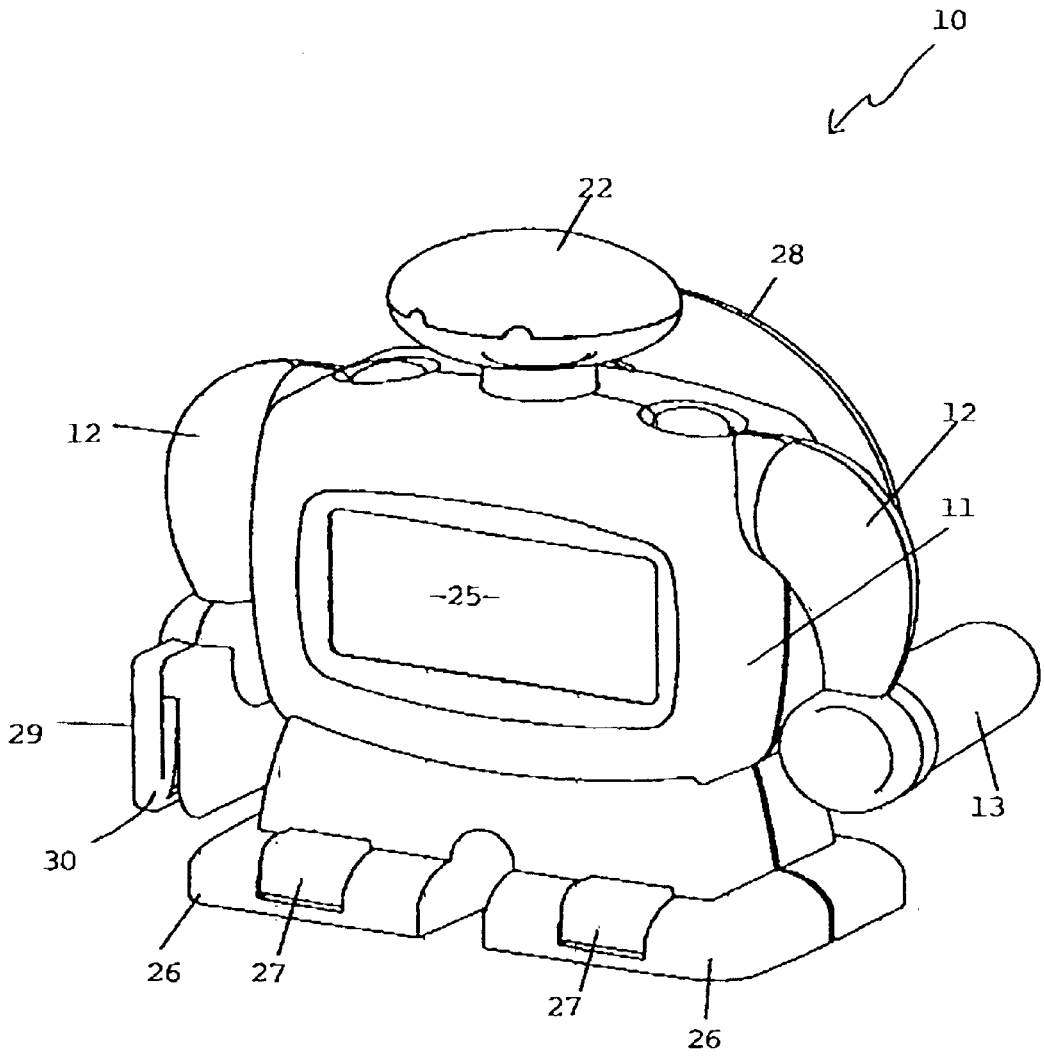
FIG. 1 is a schematic perspective illustration of a stationery holder.

In the accompanying drawings there is depicted schematically a stationery holder 10. Holder 10 is typically made of moulded plastics material and in the preferred embodiment resembles a toy robot having a body 11, a head 22, feet 26 and a pair of limbs/arms 12.

There is an LCD display 25 on the front of the body 11 and there are bottoms 27 on the feet 26 to activate what is displayed on the LCD panel 25 by with an internal clock.

The arms 12 are attached pivotally to the body 11. At the distal end of one arm 12 there is a stationery receiver 13 in the form of a hollow cylinder having its forward end open. This would typically receive a pen or pencil. At the distal end of the other arm there is a stationery receiver 29 having a slot 30 for receiving an edge of one or more sheets of paper or a business card for example. There is an internal detent 31 for making a slight bend in any card or sheet inserted into the slot to assist retention thereof.

There is a notepad receiver 28 at the back of the body 11 somewhat resembling a backpack and intended for receiving a peel-off sheet notepad for example.

The body supports a head 22, being somewhat bubble-shaped, typically having an opaque top and a light-transmissive bottom 23. There might also be an internal light source such as a globe or LED (not shown) which would illuminate upon depression of the head and then dim after a short time interval.

Each limb 12 is attached pivotally to the body 11. To this end, there is extending from the shoulder portion of the limb 12 a cylindrical tube 14 within which there is located a coil spring 32. The coil spring is attached at one of its ends to the tube 14 and at its other end to the end of a shaft 15 that is fixed with respect to the body 11. The shaft 15 fits snugly within the tube 14 and viscous lubricant would be applied to the outside surface of the shaft 15 to provide smoothness and resistance to rotation of the tube 14 with respect to the shaft.

There is a release mechanism 16 comprising a key 17 that is received within a longitudinal slot 24 on the outside surface of the tube 14. The key 17 is mounted upon a pivot pin 20. At one side of the pivot pin 20 there is a return spring 19 biasing the key 17 into the slot 24. At the other side of the pivot pin 20, there is a pushbutton 18 that is a accessible from the body exterior.

Figure 2:
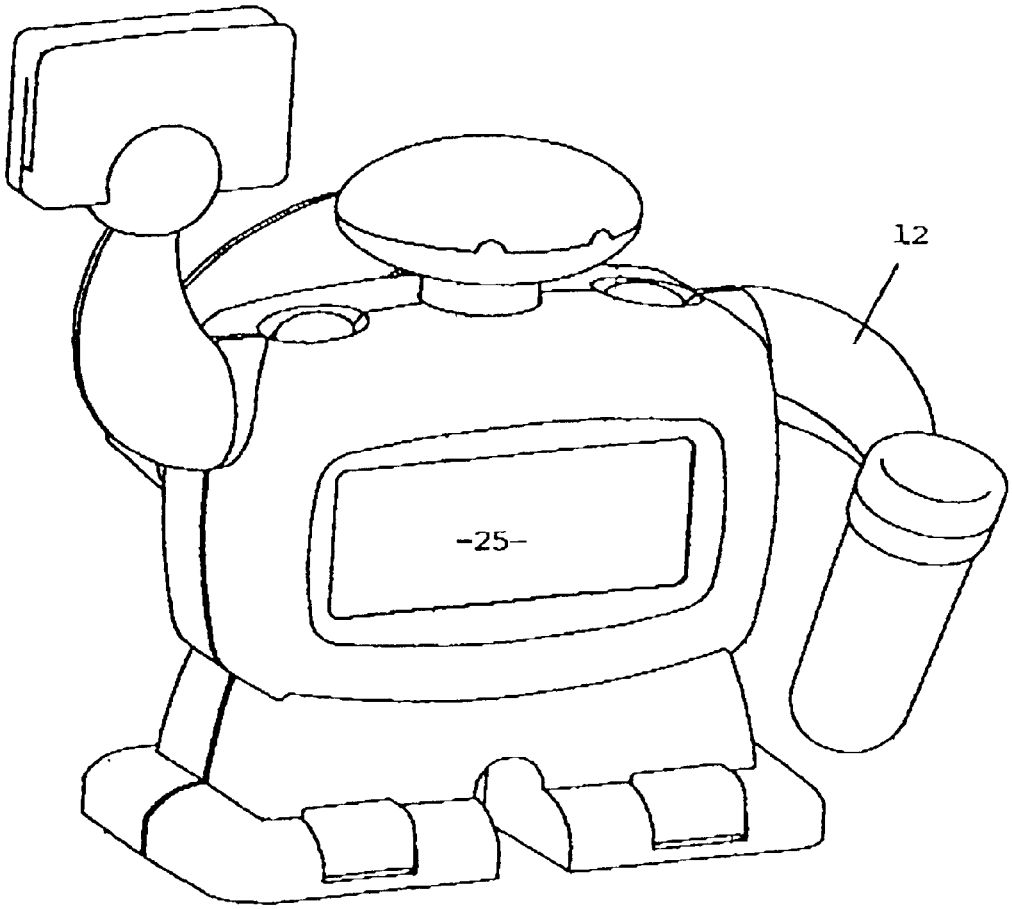
FIG. 2 is a schematic perspective illustration of the stationery holder of FIG. 1, showing its limbs reoriented.
Figure 3:
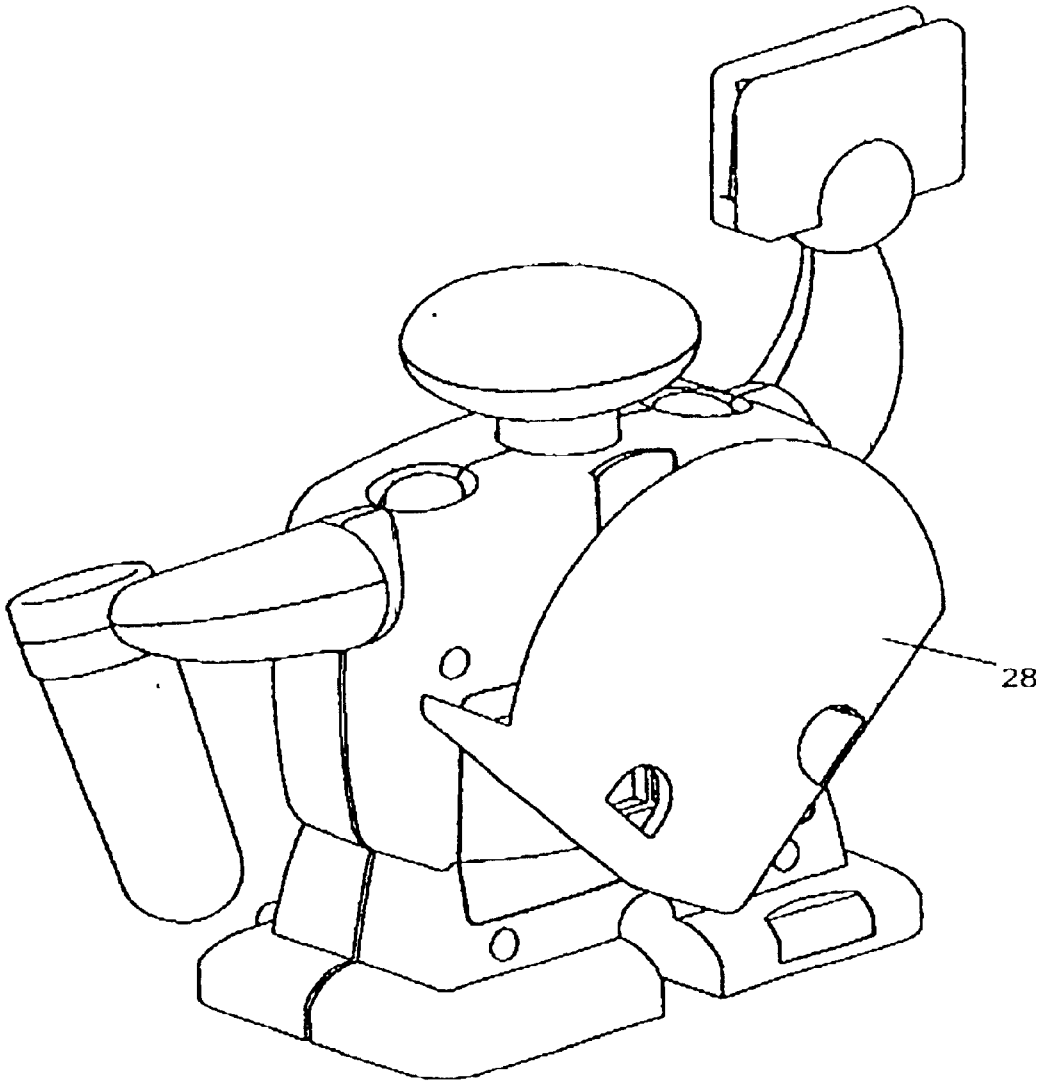
FIG. 3 is a schematic perspective illustration of the back of the stationery holder.
Figure 4:
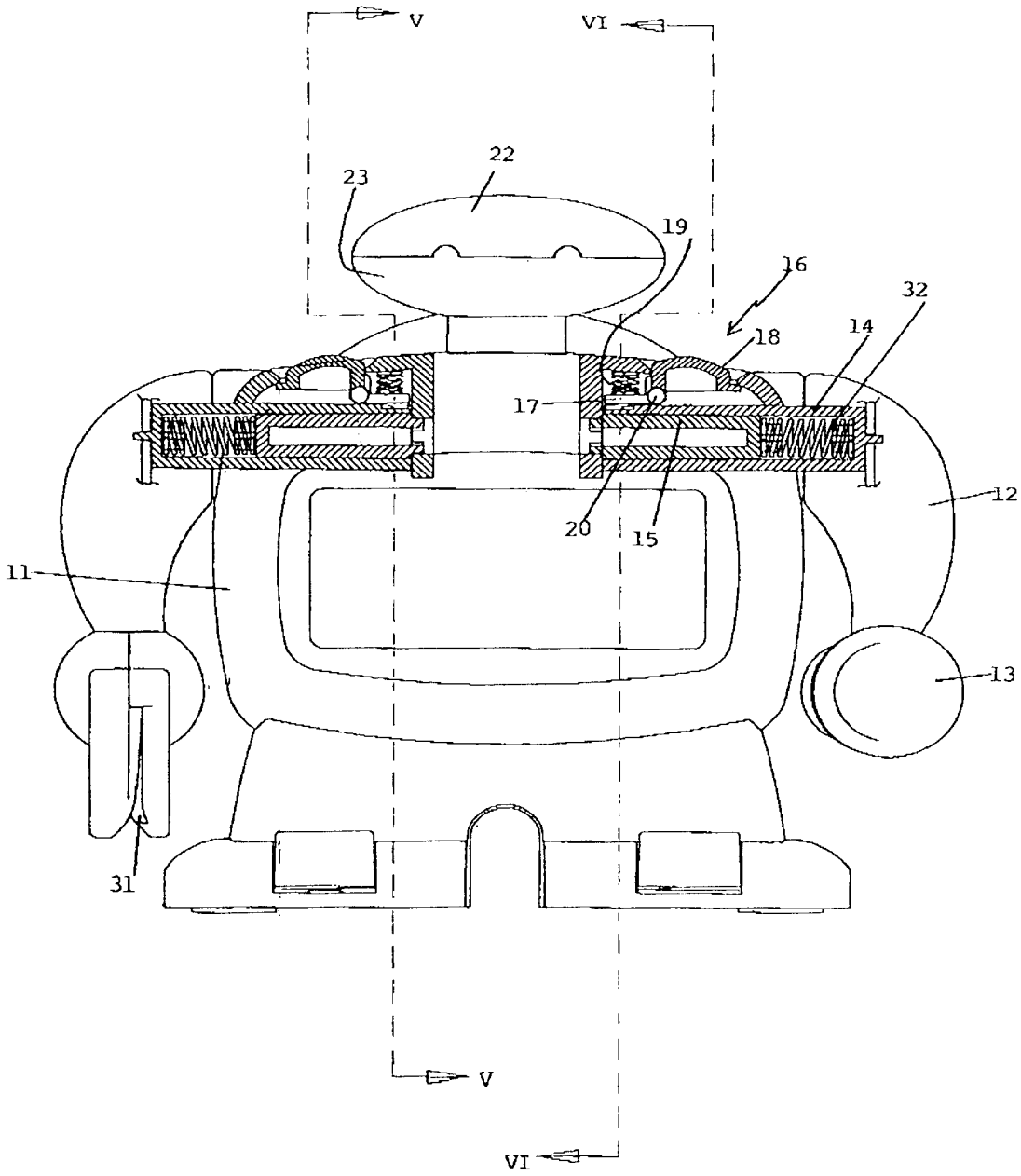
FIG. 4 is a schematic cross-sectional elevational view of the stationery holder.
Figure 5:
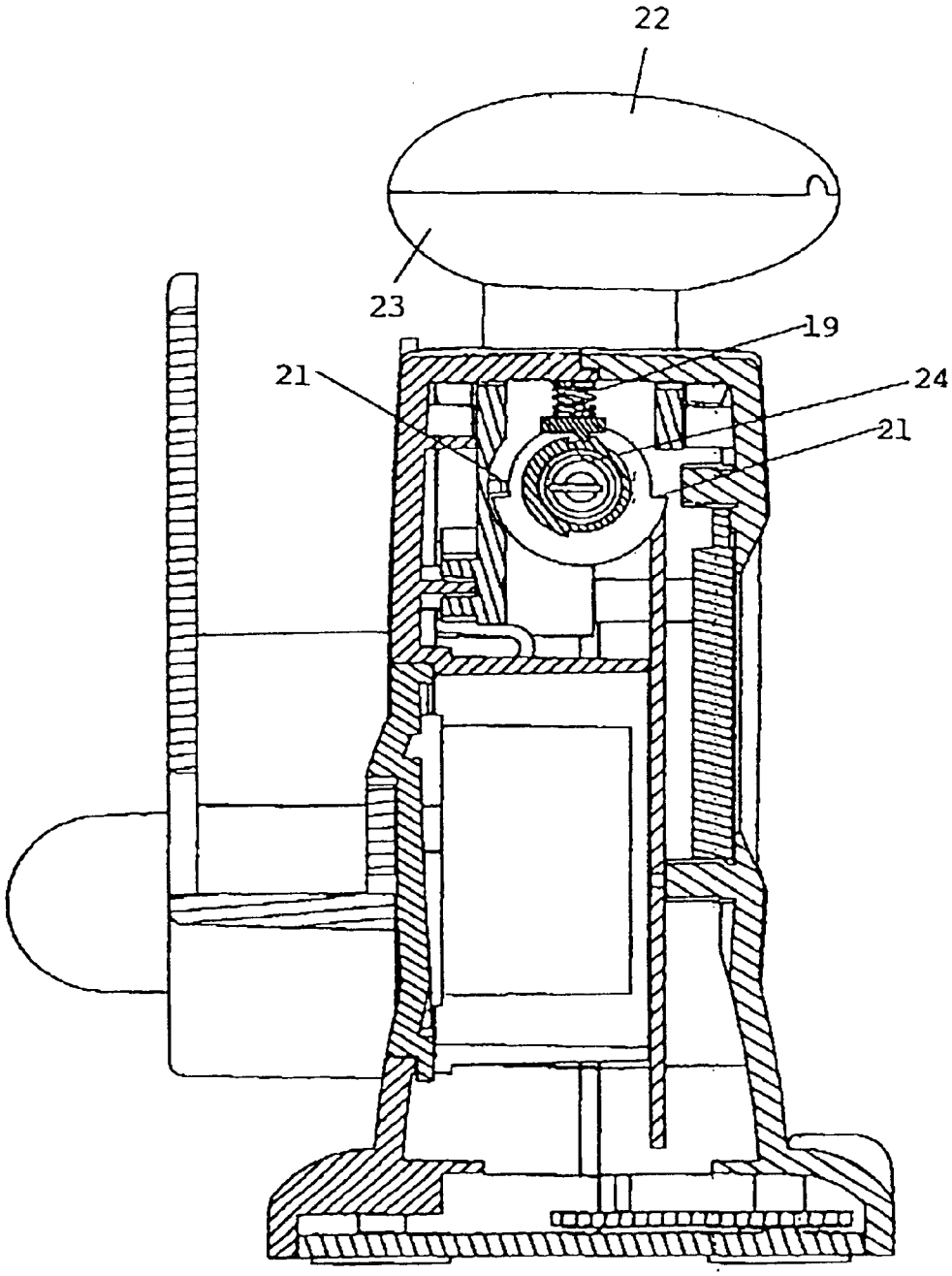
FIG. 5 is a schematic cross-sectional elevational view of the stationery holder taken at V—V in FIG. 4.
Figure 6:
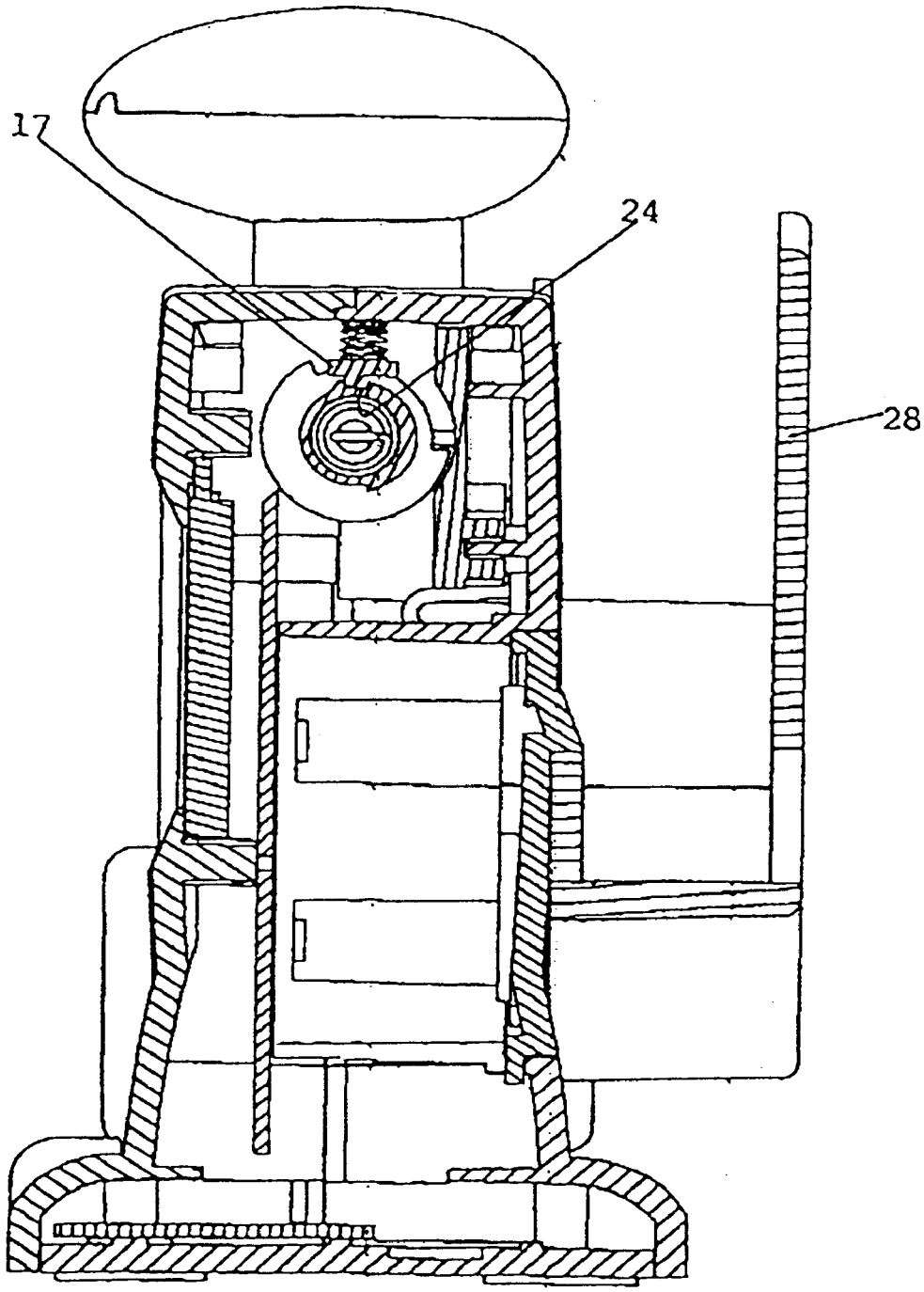
FIG. 6 is a schematic cross-sectional elevational view of the stationery holder taken at VI—VI in FIG. 4.

Upon depression of the pushbutton 18, the key 27 pivots upwardly against the return spring 19 to release the tube 14 whereupon pre-tension in the spring 32 causes the limb 12 to pivot upwardly and forwardly to the configuration depicted in FIG. 2.

There is a pair of pivot-limiting stoppers 21 fixed with respect to and therefore rotatable with the tube 14. These bear against opposed edges of the key 17 to define respective clockwise and anticlockwise pivot limits of the limb 12.

The pivot joint and release mechanism described above is repeated in mirror-form at the other shoulder of the stationery holder and functions in the same manner.

It should be appreciated that modifications and alterations obvious to those skilled in the art are not to be considered as beyond the scope of the present invention. For example, instead of the tube 14 being fixed with respect to the limb 12, it might be a fixed with respect to the body 11, in which case the shaft 15 would be fixed with respect to the limb and the pushbutton would extend from the limb. Furthermore, instead of being attached pivotally to the body, the limbs might telescope in and out with respect thereto.

What is claimed:

1. A stationery holder comprising:

a body, a limb attached movably to and extending from the body, a spring interposed between the body and the limb and biasing the limb to move with respect to the body, a stationery receiver at or near a distal end of the limb, and a release mechanism for allowing the spring to move the limb with respect to the body.

2. The stationery holder of claim 1 wherein the limb is attached pivotally to the body.

3. The stationery holder of claim 1 wherein the stationery receiver comprises a hollow cylinder having a closed end and an open end through which a pen might extend.

4. The stationery holder of claim 1 wherein the stationery receiver comprises a slot into which an edge portion of sheet material might be received tightly.

5. The stationery holder of claim 2 wherein pivotal attachment of the limb to the body comprises a tube fixed with respect to the limb or body and within which the spring is located and connected to the tube, and a shaft fixed with respect to the other of the limb or body and extending into the tube and connected to the spring.

6. The stationery holder of claim 5 comprising viscous lubricant between the shaft and tube providing resistance against pivotal movement therebetween.

7. The stationery holder of claim 5 wherein the release mechanism comprises a key-in-slot arrangement at an outside surface of the tube.

8. The stationery holder of claim 7 wherein the key-in-slot arrangement comprises a key mounted pivotally with respect to said limb or body and an exposed pushbutton extending from the key.

9. The stationery holder of claim 8 wherein the key is mounted at a pivot pin, at one side of which there is a return spring and at the other side of which there is said pushbutton.

10. The stationery holder of claim 5 further comprising a pivot-limiting stopper preventing over-pivoting of the limb with respect to the body.

11. The stationery holder of claim 1 comprising a pair of said limbs, each resembling arms.

12. The stationery dispenser of claim 1 further comprising a clock and an LCD display on the body for displaying time.

13. The stationery dispenser of claim 12 further comprising feet upon which the body sits and wherein at least one of the feet has a bottom for activating the clock.

14. The stationery dispenser of claim 1 further comprising a notepad holder extending from the body and resembling a backpack.

* * * * *